US011019982B2

(12) United States Patent
Boyer et al.

(10) Patent No.: US 11,019,982 B2
(45) Date of Patent: Jun. 1, 2021

(54) MULTIPLE USE DETERGENT DISPENSER

(71) Applicant: Midea Group Co., Ltd., Foshan (CN)

(72) Inventors: Joel Boyer, Louisville, KY (US); Greg Buth, Louisville, KY (US); Bassam Fawaz, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 420 days.

(21) Appl. No.: 16/215,030

(22) Filed: Dec. 10, 2018

(65) Prior Publication Data

US 2020/0178756 A1 Jun. 11, 2020

(51) Int. Cl.
*A47L 15/44* (2006.01)
*D06F 39/02* (2006.01)

(52) U.S. Cl.
CPC ..... *A47L 15/4463* (2013.01); *A47L 15/4472* (2013.01); *D06F 39/02* (2013.01)

(58) Field of Classification Search
CPC .. A47L 15/44; A47L 15/4409; A47L 15/4463; A47L 15/4472; D06F 39/02
USPC ..... 134/93; 222/168.5, 169, 170, 171, 172, 222/144
See application file for complete search history.

(56) References Cited

U.S. PATENT DOCUMENTS 3,567,076 A 3/1971 Zanussi
5,261,432 A 11/1993 Sandrin
7,472,710 B2 1/2009 Jowett et al.
8,221,696 B2 7/2012 Brandt et al.
8,329,112 B2 12/2012 Gibis et al.
8,375,962 B2 2/2013 Gibis et al.
8,506,896 B2 8/2013 Hofte et al.
8,613,891 B2 * 12/2013 Hofte ..... A47L 15/4463 422/271
9,717,393 B2 8/2017 Delgado et al.
2004/0065670 A1 * 4/2004 Morgan ..... B65D 83/0472 221/33
2005/0236420 A1 * 10/2005 Jowett ..... A47L 15/4463 221/248

(Continued)

FOREIGN PATENT DOCUMENTS

CN 101314910 A 12/2008
CN 103276563 A 9/2013

(Continued)

OTHER PUBLICATIONS

International Search Report and Written Opinion issued in Application No. PCT/CN2019/097405 dated Oct. 29, 2019.

*Primary Examiner* — Kevin G Lee
(74) *Attorney, Agent, or Firm* — Middleton Reutlinger

(57) ABSTRACT

A detergent dispenser may be positioned to dispense detergent into a wash tub of a household appliance, and may include: a detergent carrier with a plurality of detergent units, each of the detergent units including one or more walls defining a cavity with a dispensing opening, and a door movable between an open and closed position; a housing for receiving the detergent carrier, the housing including a dispensing outlet; a carrier driver for moving the detergent carrier between a plurality of positions, each position orienting one of the dispensing units proximate the dispensing outlet, where when one of the dispensing units is proximate the dispensing outlet the door of the one of the plurality of dispensing units is open, otherwise the door is closed.

23 Claims, 10 Drawing Sheets

(56) References Cited

U.S. PATENT DOCUMENTS

| | | | | |
|---|---|---|---|---|
| 2011/0087367 | A1* | 4/2011 | Gadini | A47L 15/4472<br>700/231 |
| 2018/0002857 | A1 | 1/2018 | Hombroek et al. | |

FOREIGN PATENT DOCUMENTS

| | | | |
|---|---|---|---|
| CN | 203247428 | U | 10/2013 |
| CN | 106400407 | A | 2/2017 |
| CN | 108951007 | A | 12/2018 |
| EP | 1493375 | A1 | 1/2005 |
| WO | WO1988006199 | A1 | 8/1988 |
| WO | WO2017215833 | A1 | 12/2017 |

* cited by examiner

MULTIPLE USE DETERGENT DISPENSER

BACKGROUND

Dishwashers are used in many single-family and multi-family residential applications to clean dishes, silverware, cutlery, cups, glasses, pots, pans, etc. (collectively referred to herein as "utensils"). Most conventional dishwashers rely on a single-use detergent dispenser, often located on the interior of the door of the dishwasher. Such conventional dispensers include an opening allowing for a volume of liquid, powder, or dissolvable pod or capsule detergent to be loaded for a single wash. During a wash cycle such a dispenser is opened allowing the entirety of the contents of be expelled; as such, a user is required to reload the dispenser before each wash cycle is started. In certain instances, it may be desirable to minimize the number of times user is required to fill the detergent dispenser. A need therefore exists in the art for a multi-use dispenser.

SUMMARY

The herein-described embodiments address these and other problems associated with the art by providing a dishwasher using a multiple use detergent dispenser. In some aspects, a dishwasher described herein includes: a wash tub; and a detergent dispenser positioned to dispense detergent into the wash tub including: a detergent carrier including a plurality of detergent units, each of the detergent units including: one or more walls defining a cavity having a dispensing opening, and a door movable between an open and a closed position; a housing configured to receive the detergent carrier, the housing including a dispensing outlet; a carrier driver configured to move the detergent carrier between a plurality of positions, each position orienting one of the plurality of dispensing units proximate the dispensing outlet, where when one of the plurality of dispensing units is proximate the dispensing outlet the door of the one of the plurality of dispensing units is open, otherwise the door is closed.

In some embodiments, each door further includes a guide and the housing further includes a track configured to receive the guide of each door. In such embodiments, the track may be arranged and configured such that for the door of each detergent unit that is not oriented proximate the dispensing outlet, the guide of such door is received within the track to position such door in the closed position. In some instances, the plurality of positions may include a first position where a first detergent unit among the plurality of detergent units is oriented proximate the dispensing outlet and a second position where a second unit among the plurality of detergent units is oriented proximate the dispensing outlet, where the track is arranged and configured such that when the carrier driver moves the detergent carrier from the first position to the second position, the track guides the door of the first detergent unit from the open position to the closed position and guides the door of the second detergent unit from the closed position to the open position. In other instances, each door may be biased to the open position, where the plurality of positions includes a first position where a first detergent unit among the plurality of detergent units is oriented proximate the dispensing outlet and a second position where a second unit among the plurality of detergent units is oriented proximate the dispensing outlet, where the track is arranged and configured such that when the carrier driver moves the detergent carrier from the first position to the second position, the track guides the door of the first detergent unit from the open position to the closed position and releases the door of the second detergent unit such that the bias of the door of the second detergent unit moves the door of the second detergent unit from the closed position to the open position.

In some embodiments, the housing further includes a cam disposed proximate the dispensing opening and configured to move the door from the open position to the closed position following dispensing of detergent. In other embodiments, the housing is coupled to a dishwasher door that provides external access to the dishwasher.

In some embodiments, each detergent unit includes a spring that biases the door for such detergent unit to the open position. In other embodiments, each detergent unit further includes a seal coupled to one of the door for such detergent unit and the dispensing opening for such detergent unit to seal the cavity of such detergent unit when the door of such detergent unit is in a closed position. In still other embodiments, the cavity of each detergent unit further includes a loading opening. In such instances, the detergent dispenser may further include a removable lid and a seal coupled to one of the detergent carrier and the removable lid to seal the loading opening of each detergent unit when the removable lid is secured to the detergent dispenser. Such a removable lid may secure to and move with the detergent carrier.

In some embodiments, the carrier driver includes a motor that rotates the detergent carrier between the plurality of positions. In such instances, the motor may be a stepper motor. In other embodiments, the carrier driver includes one or more micro switches configured to detect if one of the plurality of dispensing units is proximate the dispensing outlet.

In other aspects, a dishwasher described herein includes: a wash tub; and a rotating detergent dispenser positioned to dispense detergent into the wash tub including: a detergent carrier including a plurality of detergent units, each of the detergent units including: one or more walls defining a cavity having a dispensing opening and a loading opening, a door movable between an open and a closed position, the door biased to the open position and having a guide, and a seal coupled to one of the door for such detergent unit and the dispensing opening for such detergent unit to seal the cavity of such detergent unit when the door of such detergent unit is in a closed position, a removable lid and a seal coupled to one of the detergent carrier and the removable lid to seal the loading opening of each detergent unit when the removable lid is secured to the detergent dispenser; a housing for receiving the detergent carrier, the housing including a dispensing outlet and a track for receiving the guide of each door; a carrier driver configured to rotate the detergent carrier between a plurality of positions, each position orienting one of the plurality of dispensing units proximate the dispensing outlet, and where when one of the plurality of dispensing units is proximate the dispensing outlet the door of the one of the plurality of dispensing units is open, otherwise the door is closed.

In some embodiments, the carrier driver includes one or more micro switches configured to detect if one of the plurality of dispensing units is proximate the dispensing outlet. In other embodiments, the carrier driver includes a stepper motor.

In some embodiments, the housing further includes a cam disposed proximate the dispensing opening and configured to move the door from the open position to the closed position following dispensing of detergent.

In still other aspects, a detergent dispenser positioned to dispense detergent into a household appliance described herein includes: a detergent carrier including a plurality of detergent units, each of the detergent units including: one or more walls defining a cavity having a dispensing opening, and a door movable between an open and a closed position; a housing for receiving the detergent carrier, the housing including a dispensing outlet; a carrier driver for moving the detergent carrier between a plurality of positions, each position orienting one of the plurality of dispensing units proximate the dispensing outlet; and where when one of the plurality of dispensing units is proximate the dispensing outlet the door of the one of the plurality of dispensing units is open, otherwise the door is closed.

In some embodiments, the household appliance is a dishwasher and the housing is coupled to a dishwasher door that provides external access to the dishwasher. In other embodiments, the household appliance is a washing machine.

These and other advantages and features, which characterize the invention, are set forth in the claims annexed hereto and forming a further part hereof. However, for a better understanding of the invention, and of the advantages and objectives attained through its use, reference should be made to the figures, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
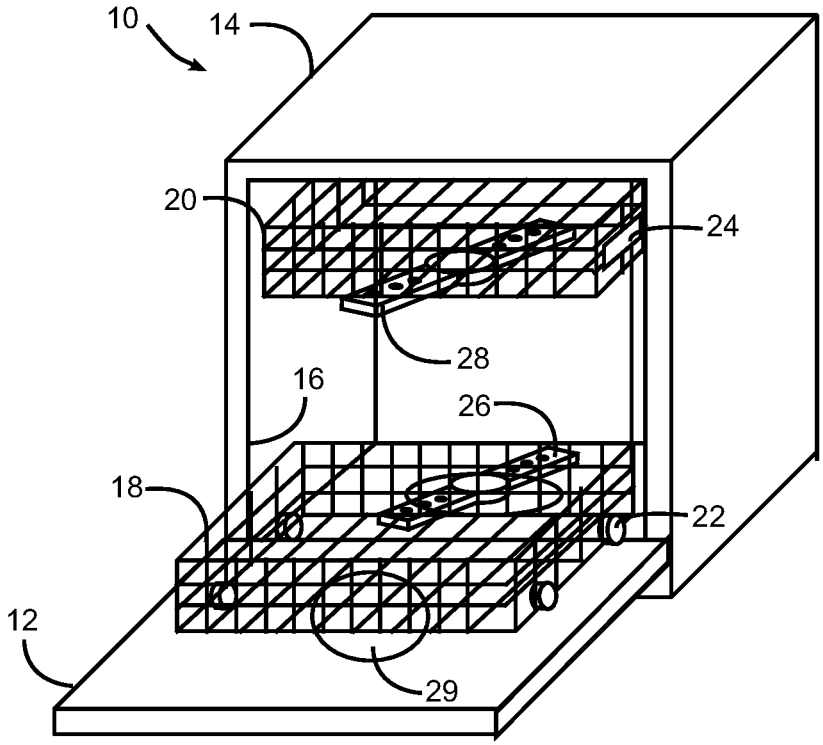
FIG. 1 is a perspective view of a dishwasher consistent with some embodiments of the invention.

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle. Additionally, dishwasher 10 may include one or more rotating spray arms, e.g., lower spray arms 26, upper spray arm 28, or other sprayers, including various combinations of wall-mounted sprayers, rack-mounted sprayers, oscillating sprayers, fixed sprayers, rotating sprayers, focused sprayers, etc. However, this positioning is not intended to be limiting, as various sprayers may be positioned through the dishwasher.

In addition, consistent with some embodiments of the invention, dishwasher 10 may include a movable detergent dispenser 29 with multiple dishwashing cycles' worth of detergent within the dispenser 29, so that it is not necessary for a user to add additional detergent before each dishwashing cycle. Such a detergent dispenser 29 may be positioned, as illustrated in FIG. 1, on the interior if the door 12. However, this positioning is not intended to be limiting, and in some embodiments the detergent dispenser may be positioned in other locations within the dishwasher.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
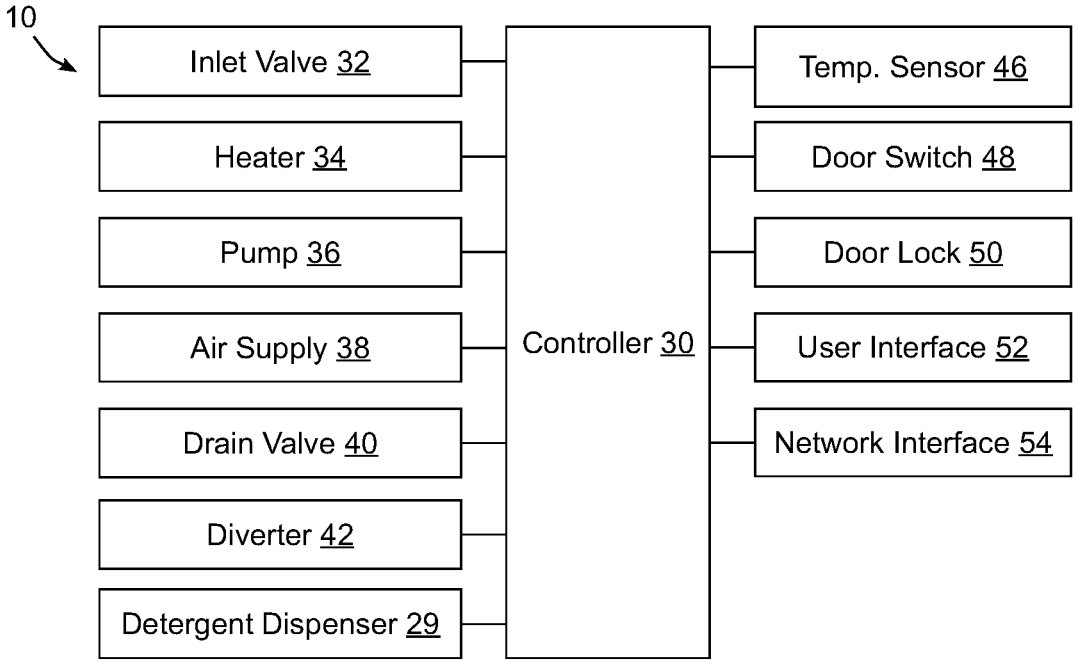
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components of the dishwasher 10, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that may provide a source of pressurized air for use in drying utensils in the dishwasher, a drain valve 40 that is coupled to a drain to direct fluids out of the dishwasher, and a diverter 42 that controls the routing of pumped fluid to different spray arms and/or other sprayers during a wash cycle.

Controller 30 may also be coupled to the detergent dispenser 29 to trigger the dispensing of detergent into the wash tub at appropriate points during a wash cycle. More particularly, the controller 30 may be coupled to a carrier driver of the detergent dispenser 29, which may include one or more micro switches or a stepper motor in order to control and/or determine the positioning of the various detergent cavities (discussed in greater detail herein). Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher 10 illustrated in FIGS. 1 and 2 will be apparent to one of ordinary skill in the art, as will become apparent from the description below. Therefore, the invention is not limited to the specific implementations discussed herein.

Figure 3:
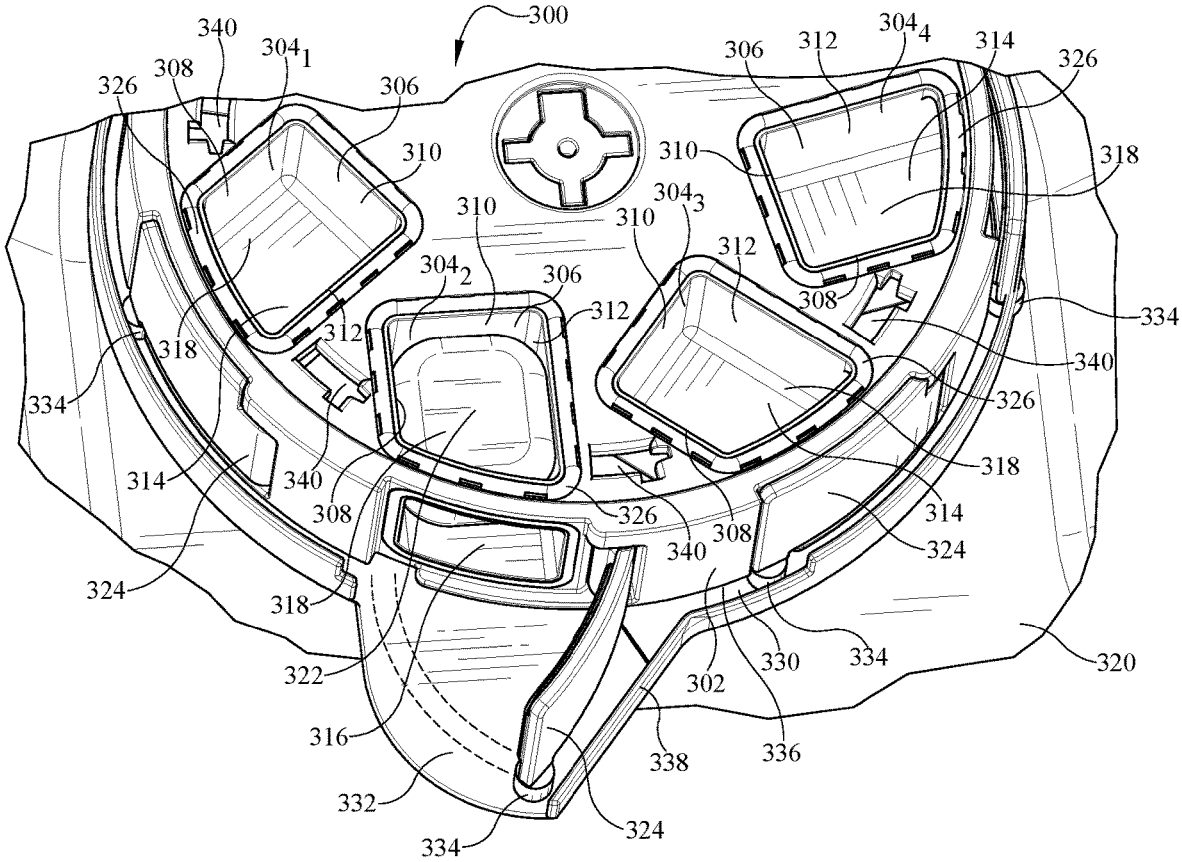
FIG. 3 is a partial upper perspective view of an example detergent dispenser consistent with some embodiments of the invention.
Figure 4:
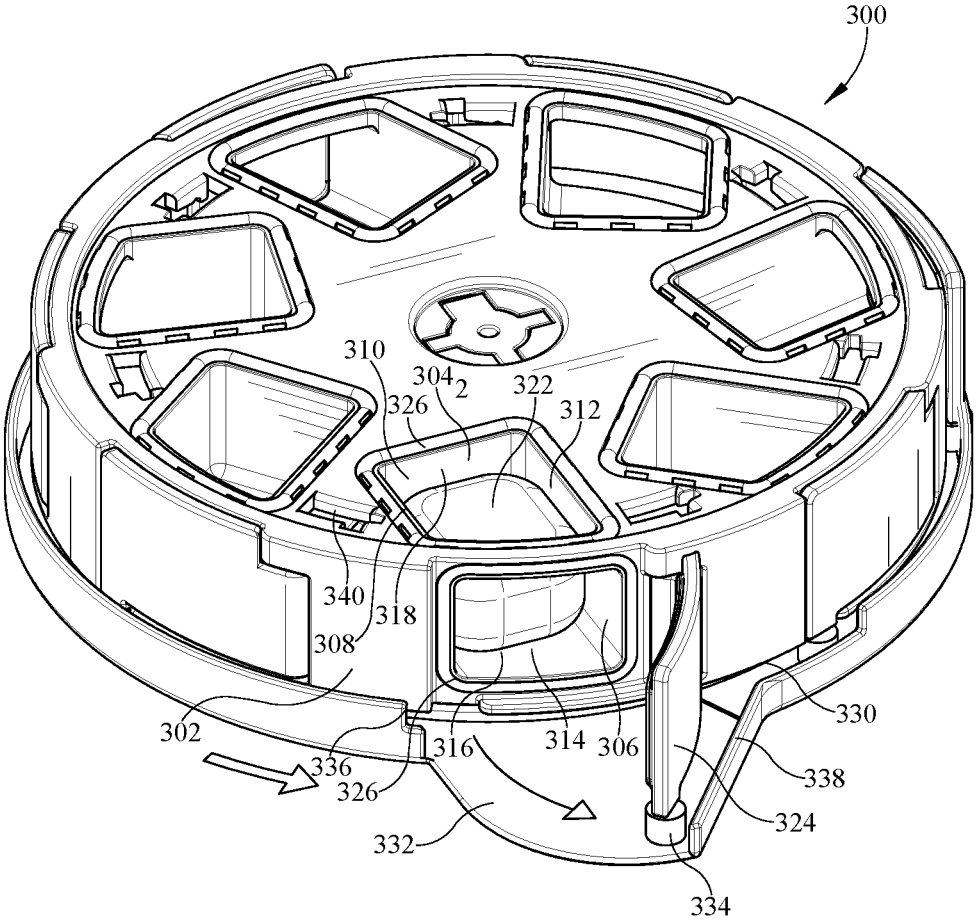
FIG. 4 is another perspective view of the example detergent dispenser of FIG. 3.
Figure 5:
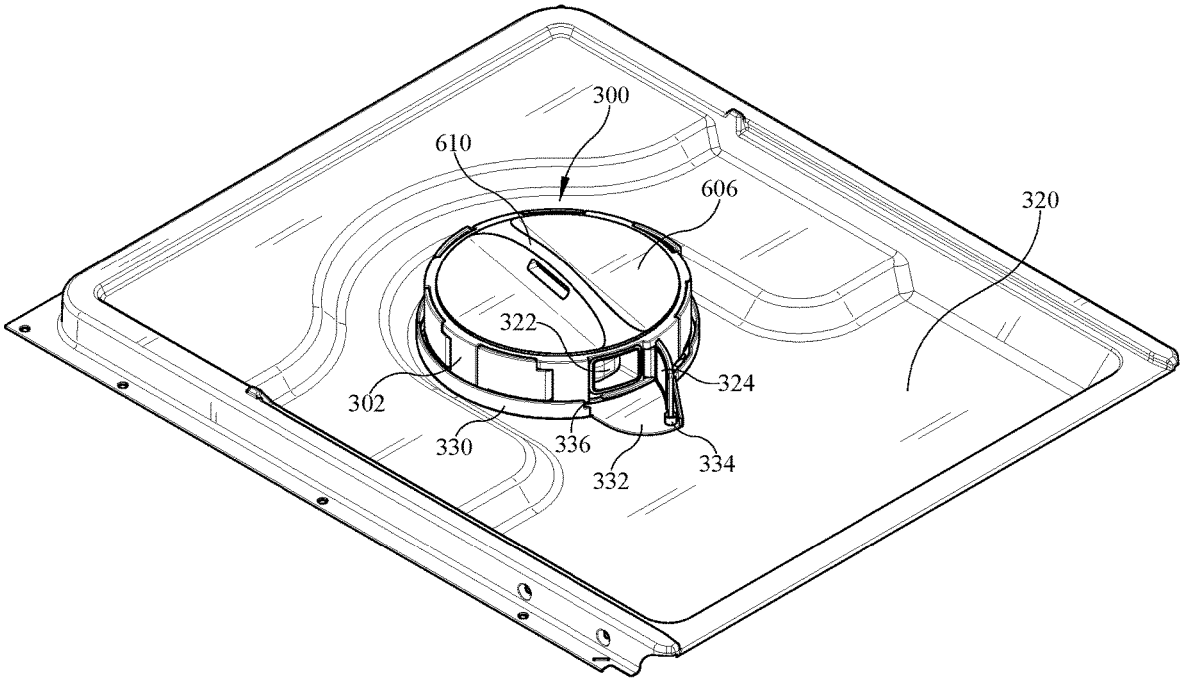
FIG. 5 is a perspective view of the example detergent dispenser of FIG. 3 disposed on a door of a dishwasher.

Now turning to FIGS. 3-5, which illustrate an example detergent dispenser 300 in which the various technologies and techniques described herein may be implemented. In some embodiments, the detergent dispenser 300 may include a detergent carrier 302 and a housing 330 (described in greater detailer below) for receiving the detergent carrier. The detergent carrier 302 may include multiple detergent units $\mathbf{304}_{1\text{-}n}$, each of which configured to hold a single wash cycle's worth of detergent. Each detergent unit $\mathbf{304}_{1\text{-}n}$ may include one or more walls defining a cavity 306; for example, as illustrated in FIGS. 3-4, each detergent unit $\mathbf{304}_{1\text{-}n}$ includes a first side wall 308, a second side wall 310, a third side wall 312, and a lower wall 314. The first side wall 308, second side wall 310, third side wall 312, and lower wall 314 collectively define the cavity 306 having two openings: a loading opening 316 and a dispensing opening 318. As illustrated in FIGS. 3-5, the loading opening 316 is disposed so as to be easily accessible to a user when the door 320 of the dishwasher is open in order to facilitate the loading process; however, the dispensing opening 318 is disposed so that when the door 320 of the dishwasher is closed the detergent contained therein will drop into the proper location within the wash tub when in a dispensing position. In some embodiments, each detergent unit $\mathbf{304}_{1\text{-}n}$ may additionally include an ejection mechanism used to eject the detergent into the proper location within the wash tub. In other embodiments, the dishwasher may spray water or other liquid into the cavity 306 in order to wash the detergent from the cavity 306.

In some embodiments, each detergent unit $\mathbf{304}_{1\text{-}n}$ of the detergent carrier 302 may additionally contain an upper wall, such that only a single opening is defined. In such an embodiment, a single wash cycle worth of detergent may be loaded into the cavity and dispensed from the cavity using the same opening.

In some embodiments, the detergent carrier 302 may be removable from the housing 330 so that a user may load the dispensing units $\mathbf{304}_{1\text{-}n}$ with detergent or clean the detergent carrier 302 at a secondary location (e.g. a kitchen countertop, etc.). However, in other embodiments, the detergent carrier 302 may be permanently affixed to the housing 330.

As stated, each detergent unit $\mathbf{304}_{1\text{-}n}$ may be configured to hold one dishwashing cycle's worth of detergent; this includes detergent of all varieties, including, but not limited to, liquid detergent, powder detergent, and/or dissolvable pod or capsule detergent. As illustrated in FIGS. 3-4, one of the detergent units $\mathbf{304}_2$ contains a dissolvable dishwashing pod/capsule 322. In some embodiments, the detergent carrier 302 may include seven detergent units $\mathbf{304}_{1\text{-}n}$, for example to correspond to the seven days of the week. In other embodiments, the detergent carrier may include five detergent units $\mathbf{304}_{1\text{-}n}$. In still other embodiments, the detergent carrier 302 may include any number of detergent units as is practical.

Furthermore, each detergent unit $\mathbf{304}_{1\text{-}n}$ may include a door 324 or closure configured to cover the dispensing opening 318. Each door 324 may be moveable between an open position (e.g. when the detergent contained therein may be released) and a closed position. In some embodiments, each door 324 may be spring-operated (for example through use of a torsional spring) for movement between the open and closed positions. In other embodiments, the door 324 may be moved between the open and closed positions by an actuator, solenoid, or any other mechanical means known in the art. In still other embodiments, the door 324 may be moved between the open and closed positions via a track that guides a guide, pin, wheel or other structure on the door coincident with movement of the carrier between different positions.

In some embodiments, each door 324, loading opening 316, and/or dispensing opening 318 of the detergent unit $\mathbf{304}_{1\text{-}n}$ may additionally include a seal 326 designed to minimize or prevent entry of water or other liquid into each of the cavities 306 when the door 324 is in a closed position. In some instances, these seals 326 may utilize compression forces in order to seal the opening and prevent leakage. As a non-limiting example, these seals 326 may be face seals, which are typically utilized to prevent leakage in the radial direction with respect to the axis of the seal.

In some embodiments, such as illustrated in FIGS. 3-5, the detergent dispenser 300 may include a track and guide system for facilitating movement of the door 324 of each detergent unit $\mathbf{304}_{1\text{-}n}$ between the open and closed positions. In such a system, each door 324 may additionally include a guide 334, and the housing 330 may additionally include a track 336 that is configured to receive the guide 334 of each door 324. In such embodiments, when a door 324 of detergent unit $\mathbf{304}_{1\text{-}n}$ is closed, the guide 334 is in contact with the track 336, thus holding the door 324 in a closed position. In contrast, when a particular door 324 is open the guide 334 is no longer in contact with the track 336, and as such the track 336 is no longer holding the door 324 in a closed position. In other embodiments, however, a track and guide may transition a door from a closed position to an open position, or vice versa, and as such a spring or other bias mechanism may not be used to bias a door to the open position in some embodiments.

In some instances, a spring-operated door 324 that is biased to an open position may complement the use of such a guide 334 and track 336 system. For example, the physical contact of the guide 334 with the track 336 may provide the compression necessary to hold the spring-operated door 324 (biased to an open position) in a closed position. Once compression provided by the track 336 is removed, the spring-operated door 324 will move (e.g. spring to its biased position) to an open position. As illustrated in FIGS. 3-5, in some embodiments, the guide 334 may be in the form of a wheel affixed to the door 324, and the track 336 may be in the form of a groove constructed as a part of the housing 330. In such instances, the use of a wheel may be reduce the friction generated by the contact of the guide 334 and the track 336, allowing the detergent carrier 302 to more easily and smoothly move along the track 336 of the housing 300.

In other instances, the door 324 may not be spring-operated. In such instances, the track 336 may be shaped so as to guide the door 324 to an open position. For example, the broken line illustrated in FIG. 3 indicates where the track 336 may be extended for use with a non-spring-operated door 324.

In some instances, it may be desirable to close a particular door 324 after the detergent contained therein has been dispensed into the washtub of the dishwasher. As such, in some embodiments, the track 336 may additionally include a cam 338 located near the dispensing opening 332 that is configured to engage the door 324 of the now-empty detergent unit $\mathbf{304}_{1\text{-}n}$ and facilitate the door 324 in moving from a from an open position to a closed position by providing force against the spring-operated door.

As briefly described previously, a housing 330 may (removably or fixedly) receive the detergent carrier 302. In some embodiments, the housing 330 may be a separate component of the detergent dispenser 300 separable from the dishwasher and the detergent carrier 302; while in other embodiments, the housing 330 may in incorporated (e.g. by molding or the like) directly into the door 320 of the dishwasher. The housing 330 may additionally include a dispensing outlet 332 configured to guide or direct the detergent contained in each detergent unit $\mathbf{304}_{1\text{-}n}$ to the proper location within the washtub when dispensed.

The detergent dispenser 300 may further include a carrier driver 602 (described in more detail with respect to FIGS. 6-8) for moving the detergent carrier 302 between multiple positions. For example, the detergent carrier 302 is capable of being moved to position one of the detergent units $\mathbf{304}_{1\text{-}n}$ near the dispensing outlet 332. When a particular detergent unit $\mathbf{304}_{1\text{-}n}$ is located near the dispensing outlet 332 the door 324 of that particular detergent unit $\mathbf{304}_{1\text{-}n}$ may be open so as to allow for dispensing of the detergent contained therein. When a particular detergent unit $\mathbf{304}_{1\text{-}n}$ is not located near the dispensing outlet 332 the door 324 of that particular detergent unit $\mathbf{304}_{1\text{-}n}$ may be closed and sealed so as to prevent the premature exit of the detergent contained therein, as well as to prevent the entry of water or other liquid into the cavity 306. Transitioning the detergent carrier between first and second positions may therefore move one detergent unit that is open and located near the dispensing outlet to a closed position in which the door is closed, while simultaneously moving the next detergent unit that is currently closed into the open position near the dispensing outlet to allow the door to open and dispense the detergent retained inside.

In some embodiments, such as illustrated in FIGS. 3-5, the detergent carrier 302 may rotate between the plurality of positions, such that the detergent units $\mathbf{304}_{1\text{-}n}$ are positioned in a generally circular manner.

Figure 9:
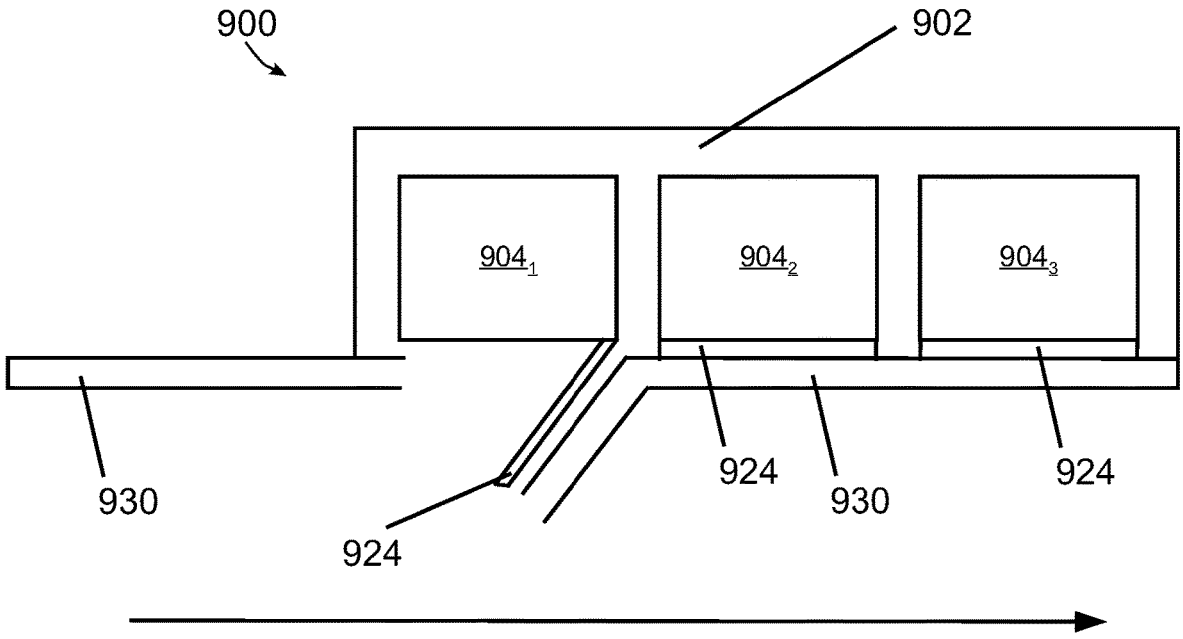
FIG. 9 is a schematic of another example detergent dispenser consistent with some embodiments of the invention.

In some embodiments, such as illustrated in FIG. 9, the movement of the detergent carrier 902 between the plurality of positions may be linear, such that each of the detergent units $\mathbf{904}_{1\text{-}n}$ is disposed along a line. Similar to the embodiments described with reference to FIGS. 3-5, in a linear embodiment of a detergent dispenser 900 each detergent unit $\mathbf{904}_{1\text{-}n}$ may include a cavity defined by one or more walls and a door 924 for holding detergent. In such an embodiment, the detergent carrier 902 may slide along a housing 930 as opposed to rotating in a generally circular manner.

Figure 6:
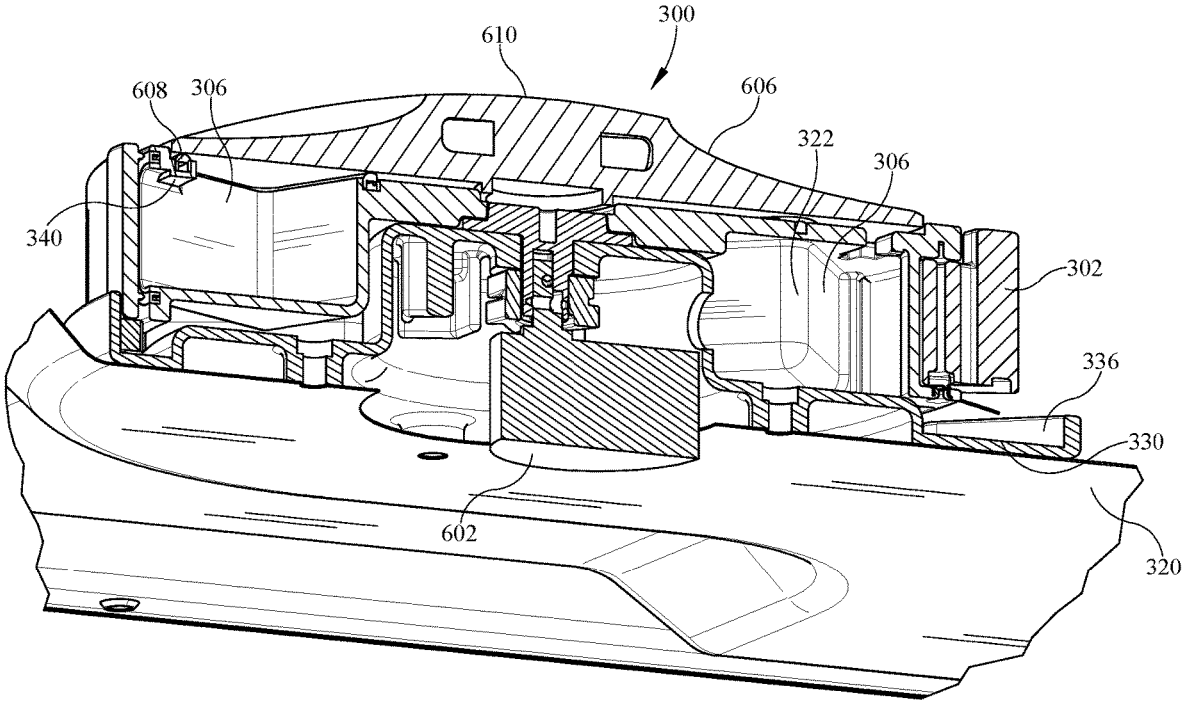
FIG. 6 is a lower perspective cross-sectional view of the example detergent dispenser of FIG. 3 disposed on a door of a dishwasher.
Figure 7:
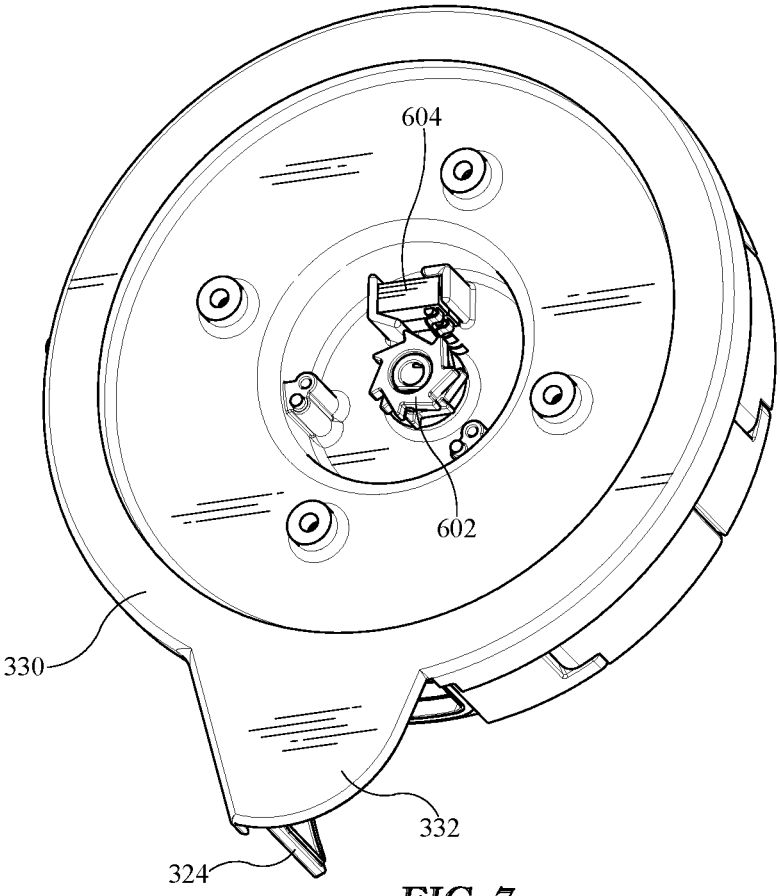
FIG. 7 is a perspective view of a carrier driver of the example detergent dispenser of FIG. 3.
Figure 8:
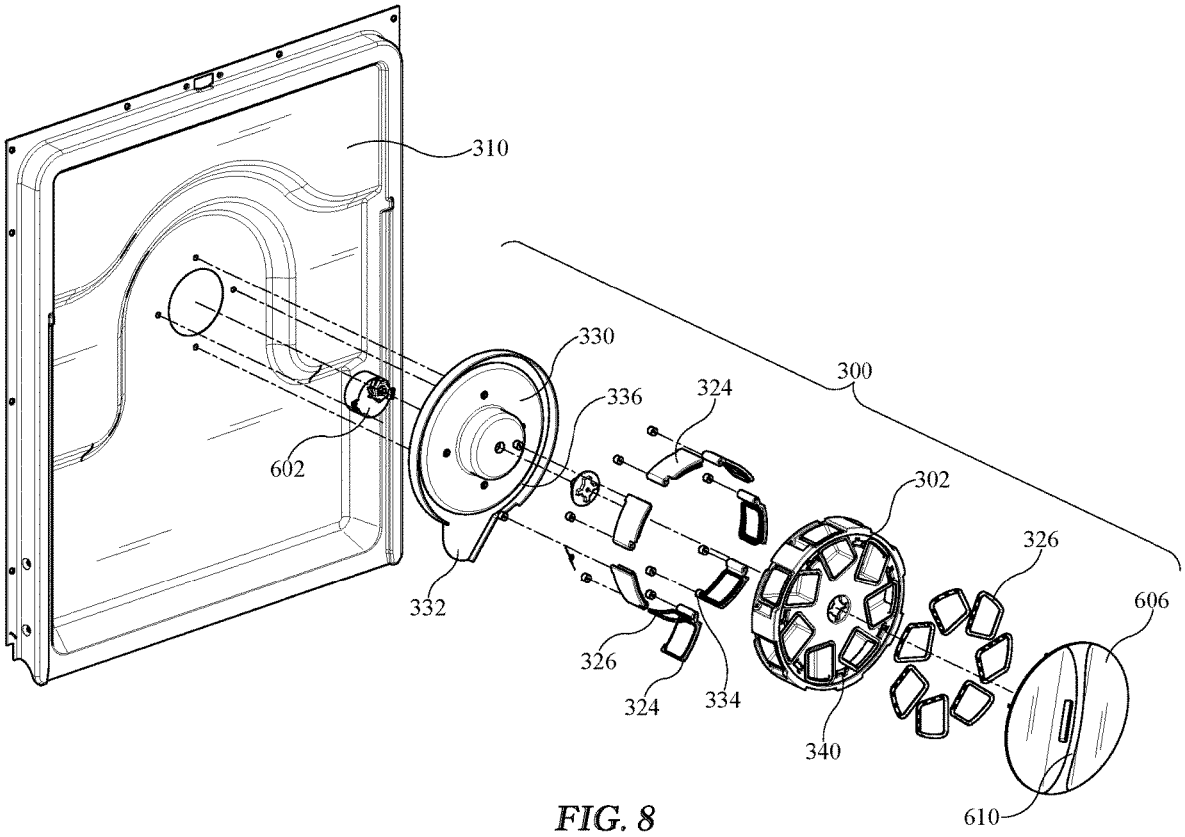
FIG. 8 is an exploded view of the example detergent dispenser of FIG. 3 disposed on a door of a dishwasher.

Turning now to FIGS. 6-8, each of which illustrate a different view of the detergent dispenser 300. As mentioned previously, the detergent dispenser 302 may include a carrier driver 602 that drives the movement of the detergent carrier 302 between a plurality of positions. In some embodiments, the carrier driver 602 may be a rotating motor that rotates the detergent carrier 302 between multiple positions, so that at any point during the rotation one of the detergent units $\mathbf{304}_{1\text{-}n}$ may positioned near the dispensing opening 332. In some instances, it may be desirable to use a stepper motor, which divides a full rotation into equal numbers of steps. In such instances, each detergent unit $\mathbf{304}_{1\text{-}n}$ may span a predetermined angle about the axis of rotation. Such an arrangement allows the stepper motor to control which one of the detergent units $\mathbf{304}_{1\text{-}n}$ is near the dispensing outlet 332 by advancing the carrier a predetermined number of steps corresponding to that predetermined angle. In other embodiments, the carrier driver 602 may be a motor that slides the detergent carrier 302 linearly between multiple positions.

The carrier driver 602 may, in some embodiments, be positioned partially (as illustrated in FIG. 6) or wholly within an interior compartment of the door 320 of the dishwasher. In some instances, such a position may be desirable as a way of saving space and minimizing the overall size of the detergent dispenser 300; such a position may also provide additional protection for the carrier driver 602 from water or other liquid. In other embodiments, the carrier driver 602 may be disposed on the interior surface of the door 320 of the dishwasher with the remainder of the detergent dispenser 300.

In some embodiments, the carrier driver 602 may include one or more micro switches 604 that are configured to detect if one of the detergent units $\mathbf{304}_{1\text{-}n}$ is near the dispensing outlet 332. These micro switches, if present, may be actuated through minimal physical force by use of a tipping-point mechanism, and as such they may, in some instances, be desirable for the detection of a location of a detergent unit $\mathbf{304}_{1\text{-}n}$. In such embodiments, therefore, a motor other than a stepper motor may be used to rotate the carrier. Further, in some embodiments, other drives may be used to perform the rotation, e.g., a solenoid and ratchet arrangement that indexes the carrier to a next position upon each actuation of the solenoid.

Figure 10:
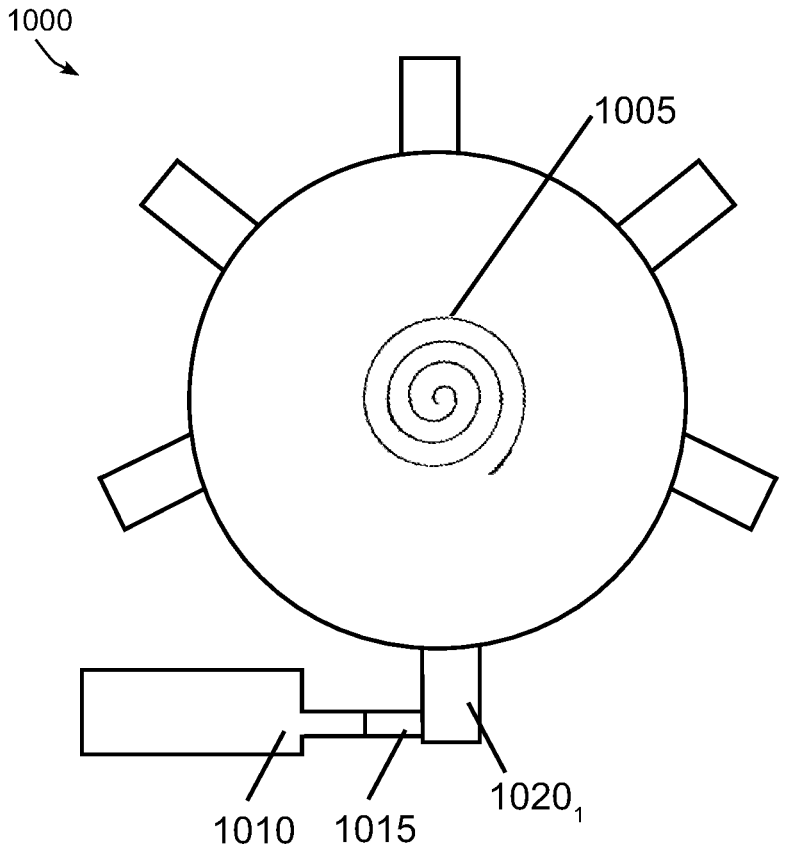
FIG. 10 is a schematic of an example carrier driver of a detergent dispenser consistent with some embodiments of the invention.

In other embodiments, such as illustrated in FIG. 10, the carrier driver 1000 may be a user-pretensioned spring 1005 (e.g. a clock spring) that may allow energy to be provided by a user and then be stored and used in order to change the position of a detergent unit (not illustrated in FIG. 10) between an open position and a closed position or vice versa. In such an embodiment, a user may "wind up" the pretensioned-spring 1005 at the time the detergent units of the detergent carrier are loaded. A solenoid 1010 may then push a pawl 1015 in order to release a ratcheted segment $\mathbf{1020}_{1\text{-}n}$, where each ratcheted segment $\mathbf{1020}_{1\text{-}n}$ corresponds to a detergent unit, which is in either an open or a closed position. For example, FIG. 10 illustrates six ratcheted segments $\mathbf{1020}_{1\text{-}n}$, which would correspond to six detergent units; this is not to be understood as limiting, as the number of ratcheted segments $\mathbf{1020}_{1\text{-}n}$ and corresponding detergent units may vary.

In some instances, particularly in embodiments where the detergent units $\mathbf{304}_{1\text{-}n}$ include a loading opening 316, the detergent dispenser 300 may additionally include a removable lid 606. Such a removable lid 606 may be configured to seal the cavity 306 at each of the loading openings 316 and minimize and/or prevent the entry of water or other liquid into each cavity 306 of the detergent units $\mathbf{304}_{1\text{-}n}$. In some instances, the lid 606 may use compression sealing, which may reduce friction while also ensuring that the cavities 306 of the detergent units $\mathbf{304}_{1\text{-}n}$ are sealed. Additionally, the lid 606 may also include one or more latching protrusions 608 that are configured to be received by a corresponding void 340 of the detergent carrier 302 in order to form a watertight seal. In some embodiments, the void 340 and latching protrusion 608 are shaped so as to require movement (e.g. twisting, rotation, or the like) of the lid 606 by a user in order for a seal to be formed, which allows for a user to easily apply and remove the lid 606 with a simple motion. As such, it may be desirable in some instances for the lid to further contain a handle 610 or a gripping point for a user. Additionally, the lid 606, particularly when attached through the use of latching protrusions 608, may move with the detergent carrier 302 as it moves. In some embodiments, such as illustrated in FIGS. 3-5, each detergent unit $\mathbf{304}_{1\text{-}n}$ includes a void 340 corresponding to a latching protrusions 608 on the lid 606, so that there is a seal at each detergent unit $\mathbf{304}_{1\text{-}n}$.

In some embodiments, the lid 606 may be constructed of a translucent material so that a user may be able to view the contents of each detergent unit $\mathbf{304}_{1\text{-}n}$. In other embodiments, the lid 606 may be colored so as to match the remainder of the detergent dispenser 300 and/or the door 320 of the dishwasher so as to be aesthetically pleasing to a user. In still other embodiments, the lid 606 may be any other color or opacity desired. In still other embodiments, the carrier may be permanently mounted to and enveloped by the housing, and no separate lid may be used. In such embodiments, each detergent unit may be loaded sequentially, e.g., through the dispensing outlet or through a separate loading outlet disposed at another radial position around the housing (e.g., proximate a top of the dishwasher door to facilitate loading by the user).

Although described herein with respect to a dishwasher, this is not intended to be limiting. The technology and techniques disclosed herein may be utilized in any household appliance that requires dispensing of a detergent, such as, for example a washing machine.

Various additional modifications may be made to the illustrated embodiments consistent with the invention. Therefore, the invention lies in the claims hereinafter appended.

What is claimed is:

1. A dishwasher, comprising:

a wash tub; and a detergent dispenser positioned to dispense detergent into the wash tub including:

a detergent carrier including a plurality of detergent units, each of the detergent units including:

one or more walls defining a cavity having a dispensing opening, and a door movable between an open and a closed position, a housing configured to receive the detergent carrier, the housing including a dispensing outlet, a carrier driver configured to move the detergent carrier between a plurality of positions, each position orienting one of the plurality of dispensing units proximate the dispensing outlet, wherein when one of the plurality of dispensing units is proximate the dispensing outlet the door of the one of the plurality of dispensing units is open, otherwise the door is closed.

2. The dishwasher of claim 1, wherein each door further includes a guide and the housing further includes a track configured to receive the guide of each door.

3. The dishwasher of claim 2, wherein the track is arranged and configured such that for the door of each detergent unit that is not oriented proximate the dispensing outlet, the guide of such door is received within the track to position such door in the closed position.

4. The dishwasher of claim 2, wherein the plurality of positions includes a first position where a first detergent unit among the plurality of detergent units is oriented proximate the dispensing outlet and a second position where a second unit among the plurality of detergent units is oriented proximate the dispensing outlet, wherein the track is arranged and configured such that when the carrier driver moves the detergent carrier from the first position to the second position, the track guides the door of the first detergent unit from the open position to the closed position and guides the door of the second detergent unit from the closed position to the open position.

5. The dishwasher of claim 2, wherein each door is biased to the open position, wherein the plurality of positions includes a first position where a first detergent unit among the plurality of detergent units is oriented proximate the dispensing outlet and a second position where a second unit among the plurality of detergent units is oriented proximate the dispensing outlet, wherein the track is arranged and configured such that when the carrier driver moves the detergent carrier from the first position to the second position, the track guides the door of the first detergent unit from the open position to the closed position and releases the door of the second detergent unit such that the bias of the door of the second detergent unit moves the door of the second detergent unit from the closed position to the open position.

6. The dishwasher of claim 1, wherein the housing further includes a cam disposed proximate the dispensing opening and configured to move the door from the open position to the closed position following dispensing of detergent.

7. The dishwasher of claim 6, wherein the detergent dispenser further includes a removable lid and a seal coupled to one of the detergent carrier and the removable lid to seal the loading opening of each detergent unit when the removable lid is secured to the detergent dispenser.

8. The dishwasher of claim 6, wherein the removable lid secures to and moves with the detergent carrier.

9. The dishwasher of claim 1, wherein the housing is coupled to a dishwasher door that provides external access to the dishwasher.

10. The dishwasher of claim 1, wherein each detergent unit includes a spring that biases the door for such detergent unit to the open position.

11. The dishwasher of claim 1, wherein each detergent unit further includes a seal coupled to one of the door for such detergent unit and the dispensing opening for such detergent unit to seal the cavity of such detergent unit when the door of such detergent unit is in a closed position.

12. The dishwasher of claim 1, wherein the cavity of each detergent unit further includes a loading opening.

13. The dishwasher of claim 1, wherein the carrier driver includes a motor that rotates the detergent carrier between the plurality of positions.

14. The dishwasher of claim 13, wherein the motor is a stepper motor.

15. The dishwasher of claim 1, wherein the carrier driver includes one or more micro switches configured to detect if one of the plurality of dispensing units is proximate the dispensing outlet.

16. The dishwasher of claim 1, wherein the carrier driver includes a user-pretensioned spring and a solenoid.

17. A dishwasher, comprising:

a wash tub; and a rotating detergent dispenser positioned to dispense detergent into the wash tub including:

a detergent carrier including a plurality of detergent units, each of the detergent units including:

one or more walls defining a cavity having a dispensing opening and a loading opening, a door movable between an open and a closed position, the door biased to the open position and having a guide, and a seal coupled to one of the door for such detergent unit and the dispensing opening for such detergent unit to seal the cavity of such detergent unit when the door of such detergent unit is in a closed position, a removable lid and a seal coupled to one of the detergent carrier and the removable lid to seal the loading opening of each detergent unit when the removable lid is secured to the detergent dispenser, a housing configured to receive the detergent carrier, the housing including a dispensing outlet and a track configured to receive the guide of each door, a carrier driver configured to rotate the detergent carrier between a plurality of positions, each position orienting one of the plurality of dispensing units proximate the dispensing outlet, and wherein when one of the plurality of dispensing units is proximate the dispensing outlet the door of the one of the plurality of dispensing units is open, otherwise the door is closed.

18. The dishwasher of claim 17, wherein the carrier driver includes one or more micro switches configured to detect if one of the plurality of dispensing units is proximate the dispensing outlet.

19. The dishwasher of claim 17, wherein the carrier driver includes a stepper motor.

20. The dishwasher of claim 17, wherein the housing further includes a cam disposed proximate the dispensing opening and configured to move the door from the open position to the closed position following dispensing of detergent.

21. A detergent dispenser positioned to dispense detergent into a household appliance, comprising:

a detergent carrier including a plurality of detergent units, each of the detergent units including:

one or more walls defining a cavity having a dispensing opening, and a door movable between an open and a closed position;

a housing configured to receive the detergent carrier, the housing including a dispensing outlet;

a carrier driver configured to move the detergent carrier between a plurality of positions, each position orienting one of the plurality of dispensing units proximate the dispensing outlet; and wherein when one of the plurality of dispensing units is proximate the dispensing outlet the door of the one of the plurality of dispensing units is open, otherwise the door is closed.

22. The detergent dispenser of claim 21, wherein the household appliance is a dishwasher and the housing is coupled to a dishwasher door that provides external access to the dishwasher.

23. The detergent dispenser of claim 21, wherein the household appliance is a washing machine.

* * * * *